US005213322A

United States Patent [19]

Matsuo et al.

[11] Patent Number: 5,213,322

[45] Date of Patent: May 25, 1993

[54] ORIGINAL TRANSFER APPARATUS

[75] Inventors: Hirokazu Matsuo; Yuusuke Morigami; Takuma Ishikawa, all of Osaka, Japan

[73] Assignee: Minolta Camera Kabushiki Kaisha, Osaka, Japan

[21] Appl. No.: 787,773

[22] Filed: Nov. 6, 1991

Related U.S. Application Data

[63] Continuation of Ser. No. 464,181, Jan. 12, 1990, abandoned.

[30] Foreign Application Priority Data

Jan. 13, 1989 [JP] Japan ..... 1-6534
Jan. 20, 1989 [JP] Japan ..... 1-5726[U]

[51] Int. Cl.[5] ..... B65H 5/02

[52] U.S. Cl. ..... 271/275; 271/198; 198/814; 355/75; 355/212

[58] Field of Search ..... 271/275, 6, 7, 12, 198, 271/272, 273; 355/212, 230, 75; 198/814

[56] References Cited

U.S. PATENT DOCUMENTS 4,146,326 3/1979 Taylor et al. ..... 355/75 X
4,364,656 12/1982 Yanagawa ..... 355/212
4,432,632 2/1984 Yokota ..... 355/212 X
4,657,372 4/1987 Ikeda et al. ..... 355/212
4,829,341 5/1989 Sasaki et al. ..... 271/265 X
4,844,445 7/1989 Murata et al. ..... 271/198 X

FOREIGN PATENT DOCUMENTS 48306 6/1983 Japan ..... 355/212
0100145 6/1983 Japan ..... 355/212
15971 1/1984 Japan ..... 355/212
62-25484 6/1987 Japan .

*Primary Examiner*—H. Grant Skaggs
*Assistant Examiner*—Carol Lynn Druzbick
*Attorney, Agent, or Firm*—Willian Brinks Olds Hofer Gilson & Lione

[57] ABSTRACT

In an original transfer apparatus, a pair of rollers around which a transfer belt is stretched and pressing rollers provided between the pair of rollers and adapted to press the transfer belt against the platen are held with each end portion of each shaft of the rollers being fixed to a frame of a body of the transfer apparatus so as to be attachable and detachable directly and separately. The fitting of these rollers is executed by fitting at least three end portions of the shafts of the pair of rollers and each end portion of each shaft of the pressing rollers to the frame from a side opposed to the platen of the frame of the body.

16 Claims, 10 Drawing Sheets

ORIGINAL TRANSFER APPARATUS

This application is a continuation of application Ser. No. 07/464,181, filed Jan. 12, 1990, now abandoned.

BACKGROUND OF THE INVENTION

1. Technical Field of the Invention

The present invention relates to an original transfer apparatus for automatically transferring an original to and discharging an original from a platen section of a copying apparatus, an image reading apparatus, a microfilm photographing apparatus or the like in which an image is exposed, read or photographed, and particularly to an original transfer apparatus provided with a transfer belt stretched between a pair of rollers so as to be opposed to the platen, and a suitable number of back-up rollers provided inside of the transfer belt and adapted to press the transfer belt in pressure contact with the platen section.

2. Description of the Related Arts

In such a kind of conventional apparatus, as a transfer means for transferring an original to and discharging an original from a platen section, usually a white belt is used. Therefore, after being used for a long time, sometimes the transfer belt becomes too soiled to be cleaned by a cleaner and a read-out image becomes also soiled. Accordingly, the transfer belt is exchanged with a new one at predetermined times.

An art for easily exchanging a transfer belt is disclosed in Japanese Unexamined Utility Model Publication No. 62-25484. In this art, supporting holes for supporting a pair of rollers around which a transfer belt is stretched are provided in a frame of a device, and each of the holes is provided with an outwardly opened cut off portion, so that a shaft of each roller is inserted through the cut off portion into the supporting hole, and by fitting the shaft into a bearing and then fitting the bearing into the supporting hole.

Further, apparatus are known in which bearing portions for supporting a pair of rollers are detached from a frame of the apparatus by removing a cover, or in which after removing a cover, a front side plate constituting a frame is detached and then a transfer belt is forwardly pulled out.

Further, an apparatus is known in which a pair of rollers with a transfer belt stretched therearound, back-up rollers and the like are set into a frame of a belt unit, and this belt unit is adapted to be attachable to and detachable from a frame of the device.

However, in the construction disclosed in the Japanese Unexamined Utility Model Publication, a cover covering the frame of the apparatus including the bearing portions has to be preliminarily moved away in order to detach the bearings for exchanging the transfer belt, so that troublesome operations are required. Further, other devices in which the transfer belt is detached after moving the cover away have the same disadvantage.

Further, in a construction in which a belt unit is attached to and detached from the frame of the device, a frame of the belt unit has to be provided in addition to the frame of the original transfer device, so that the apparatus becomes disadvantageously expensive.

Further, as shown in FIG. 1, a back-up roller a is formed of a rotation shaft b with a plurality of small rollers c fixed thereon and disposed inside of a transfer belt d. This back-up roller a is supported at the rotation shaft b thereof by a holder f fixed to a frame e for supporting the transfer belt d, and adapted to press the transfer belt d against a platen glass g by its own weight or the like. Thereby, the transfer belt d is in pressure contact with the platen glass g at some positions in the longitudinal direction to provide a transfer force, whereby a delivered original can be pulled on the platen glass g so as to be copied and discharged from the platen glass g.

However, as shown in FIG. 1, a conventional holder is fitted to the frame such that an end thereof protrudes near the edge portion of the transfer belt d, and attention must be paid to ensure that the holder can sufficiently bear the rotation shaft b and at the same time prevent the end of the holder from interfering with the edge portion of the transfer belt d.

However, since the transfer belt d is hardly supported by the back-up roller a, when it is driven, the end portion of the transfer belt d shakes between two supporting rollers h as shown in solid and imaginary lines. As a result, the end portion of the transfer belt d is apt to be in contact with an end face of the holder. Therefore, the transfer belt is apt to be worn out and damaged, and the life thereof becomes shortened.

Such a shaking of the end portion of the transfer belt d remarkably occurs when the transfer belt d is driven both in the positive and negative directions, and further, when the transfer belt g moves in zigzag direction the trouble is also serious.

SUMMARY OF THE INVENTION

A main object of the present invention is to provide an original transfer apparatus in which a transfer belt can be easily exchanged without removing a cover, and which has a simple construction and can be manufactured at a low cost.

Another object of the present invention is to provide an original transfer apparatus in which a tension can be given to a fitted transfer belt without losing simplified exchangeability of the transfer belt.

A further object of the present invention is to provide an original transfer apparatus in which a transfer belt can be easily exchanged under presence of pressing rollers for pressing the transfer belt against the platen.

A further object of the present invention is to provide an original transfer apparatus in which a supporting member for supporting pressing rollers are improved so as to prevent the end portion of a transfer belt from being worn out or damaged and thereby extend the life of the transfer belt.

Other and further objects and features of the present invention will become apparent from the following description given with reference to the appended drawings.

DETAILED DESCRIPTION OF THE PREFERRED EMBODIMENTS

Now, some embodiments of the present invention will be described in the following with reference to the appended drawings.

FIGS. 2 to 13 show a first embodiment of the present invention which is an original transfer device applied to a copying apparatus A capable of two side copying.

Figure 2:
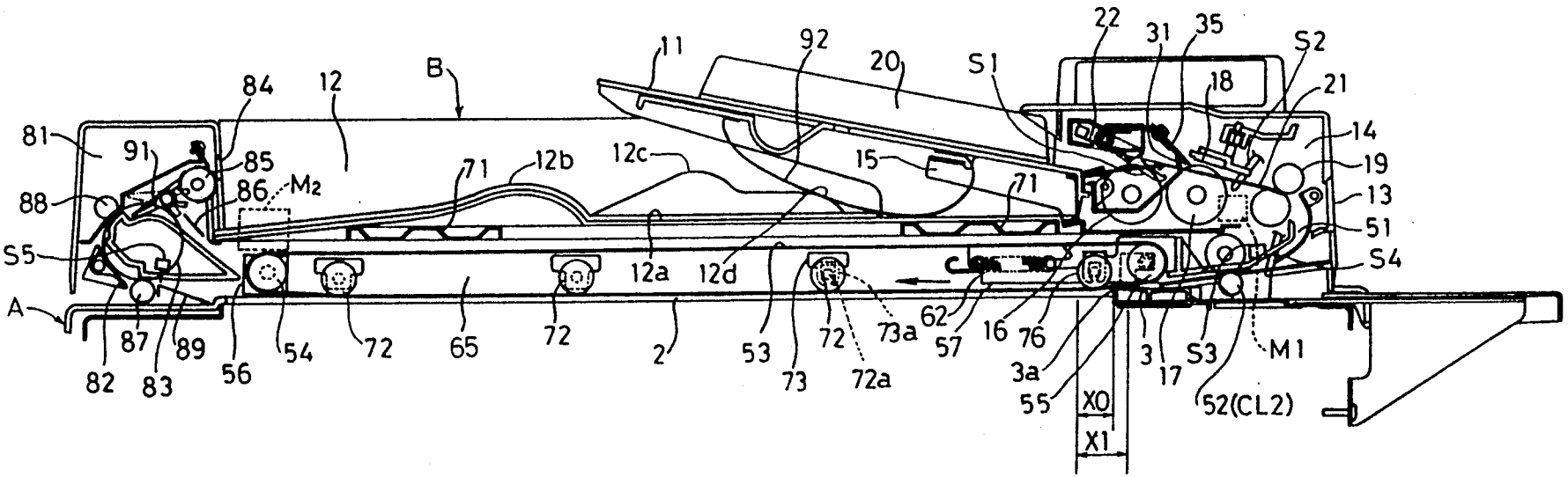
FIG. 2 is a sectional view of an original transfer apparatus of a first embodiment of the present invention.

As shown in FIG. 2, the copying apparatus A has a platen glass 2 on the upper surface. At one end of the platen glass 2, a metal original scale 3 is provided. The original scale 3 has calibrations (not shown) indicating the position of each size of original to be mounted by hand, and projects above the platen glass 2, thereby functioning as a positioning member for positioning an original. Numeral 3*a* indicates a positioning surface for executing such positioning of an original. In this embodiment, the positioning surface 3*a* is always above the platen glass 2. However, it may be so constructed as to project above the platen glass 2 only when required.

On the upper surface having the platen glass 2 of the copying apparatus A, an original transfer apparatus B is provided with its rear end portion being hinged to the apparatus A so as to be opened and closed (not shown). As a result, the original transfer apparatus B is opened and closed and functions as an original cover for urging an original mounted by hand on the platen glass 2 to be copied. Further, the original transfer apparatus B in the state of covering the platen glass 2 can automatically transfer an original onto the platen glass 2 and automatically discharge the original from the platen glass 2.

Figure 8:
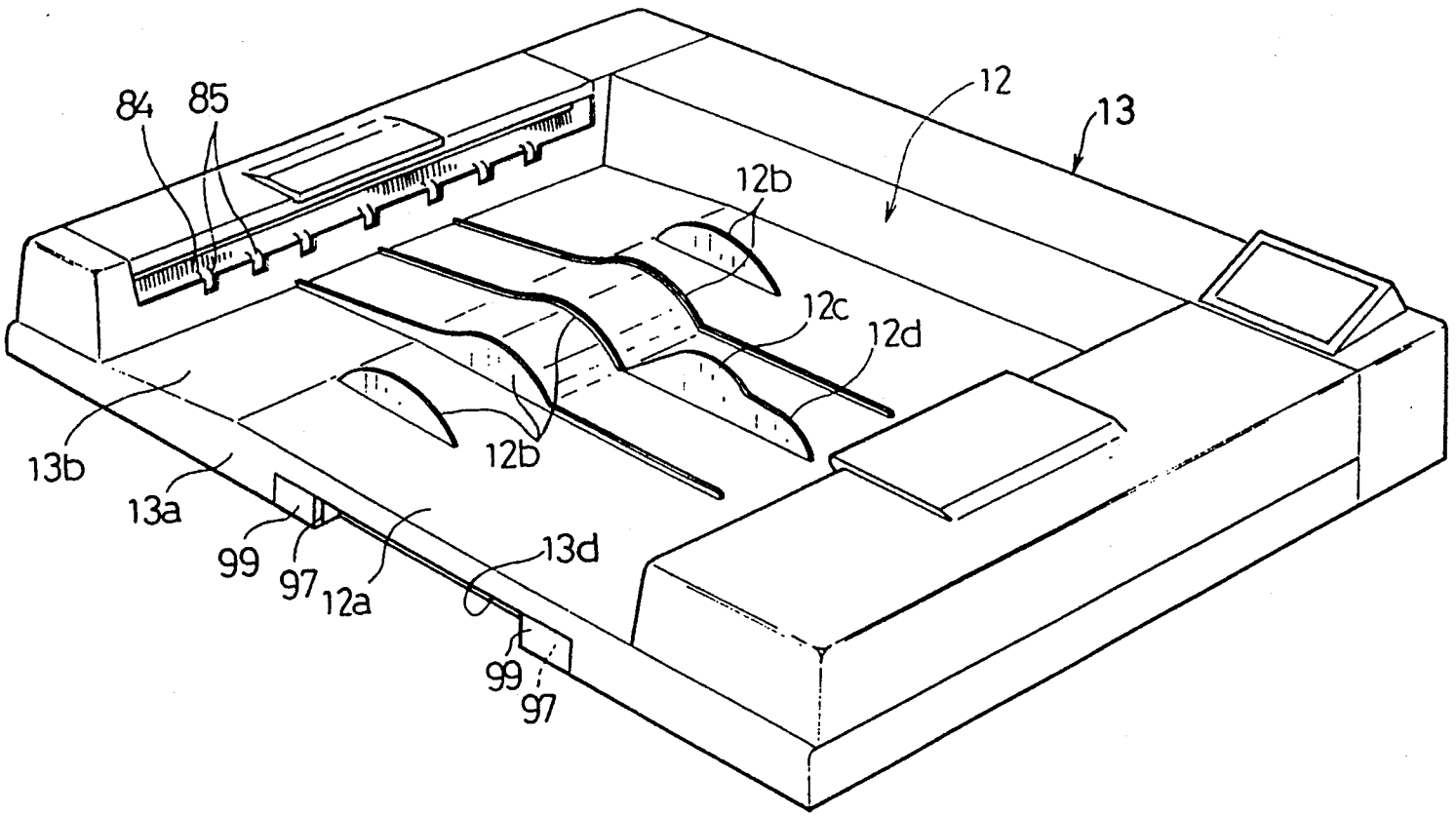
FIG. 8 is a perspective view of the original transfer apparatus with the original tray thereof removed.

At the upper part of the original transfer apparatus B, an upper original tray 11 for feeding originals and a lower original discharge tray 12 are provided. As shown in FIGS. 2 and 8, the original discharge tray 12 is formed as a recessed portion in the upper surface of the body of the original transfer apparatus B, and has a discharge opening at the front side through which an original is discharged. A paper feed section 14 is provided at the right side of the original discharge tray 12. The original tray 11 is fitted by a bracket 15 to the paper feed section 14 so as to form a downward slope toward the paper feed section 14. Further, the original tray 11 has a side guide 20 of a centering type movable in accordance with the size of an original. In the paper feed tray 14, pick-up rollers 16 for downwardly feeding an original from the original tray 11, a parting section comprising parting rollers 17 and a parting pad for parting and delivering the downwardly fed originals one by one, and a pair of feed rollers for holding and securely feeding the original delivered from the parting section are provided successively along a lower paper feed guide 21 disposed in continuation with the original tray 11.

Figure 4:
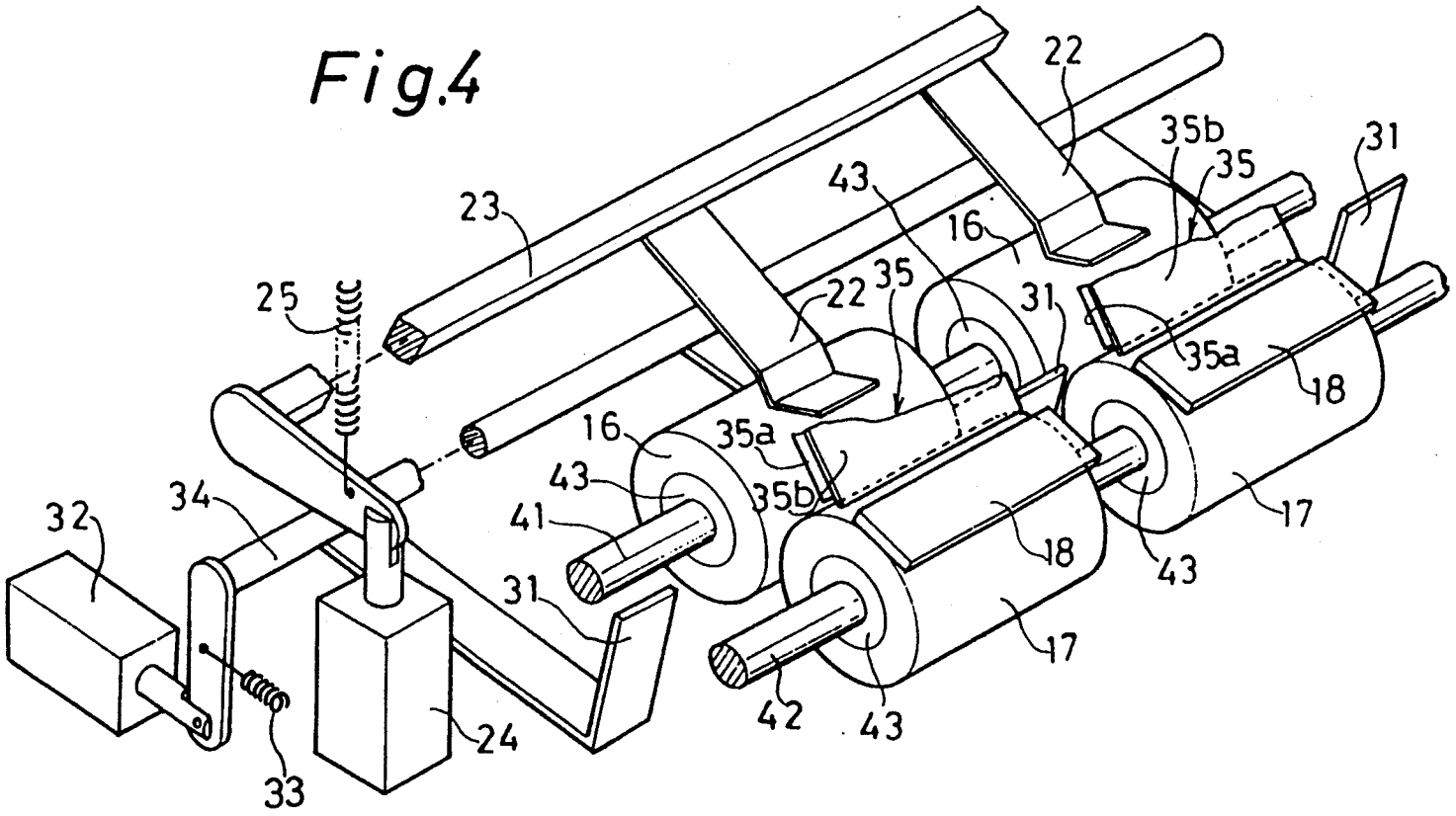
FIG. 4 is a perspective view of a part of the paper feed section.

An original stopper 31 is provided at a position directly before the parting rollers 17. The original stopper 31 is fixed to a pivotal shaft 34 which is acted on by a keep solenoid 32 (FIG. 4). Usually, the original stopper 31 is at an original receiving position protruded above the lower paper feed guide 21, receives originals which are set to provide a setting feeling and aligns the leading edges of the originals. When the solenoid 32 is turned on, the original stopper 31 retracts below the lower paper feed guide 21 against a force of a spring 33.

The pick-up rollers 16 and the parting rollers 17 are both formed of rubber and positioned directly at both sides of a center line of an original transfer path (FIG. 4).

An original pressing member 22 is provided above the right and left pick-up rollers 16. The original pressing member 22 is formed of a plate spring secured to the pivotal shaft 23. On the pivotal shaft 23, a solenoid 24 and a recoiling spring 25 act on the pivotal shaft 23. The original pressing member 22 is normally pivoted upwardly by the pulling force of spring 25. However, when the solenoid 24 is turned on, the pivotal shaft 23 makes pivotal movement against the force of the spring 25 so as to move the original pressing member 22 downwardly. Thereby the original pressing member 22 resiliently presses the originals set in the original tray 11 against the pick-up rollers 16 so that a transfer power of the pick-up rollers 16 can securely act on the lowest original.

In the early stage of feeding originals newly set in the original tray 11, a preliminary original transfer operation is executed for a predetermined time with the original pressing member being operated and the original stopper 31 being raised to the original receiving position. As a result, even if the lowest one of the originals set in the original tray 11 does not reach a predetermined position because of interference of the pick-up rollers or the like, the lowest one of the originals can be surely delivered to the original stopper 31 by the above-mentioned preliminary transfer operation, and all the originals are aligned. At this time, the original stopper 31 is moved downwardly, so that the originals can be transferred.

Without such operation, the foremost originals on the lowest one reach the parting section earlier than the lowest one and the lowest one is pulled out, and thereafter the lowest one reaches the parting section and is pulled out, thus causing multiple paper feed.

Between the original stopper 31 and the parting section, a front parting plate 35 is provided. The front parting plate 35 is secured so as to form a downward slope from the front of the parting section toward the surface of the parting rollers 17. And the leading edge of the front parting plate 35 is close to a portion directly before the contact position between the parting rollers 17 and the parting pad 18. The front parting plate 35 is formed of a metal base plate 35*a* and a resin upper plate 35*b* superposed on the metal plate 35*a*. Between the upper plate 35*b* and the parting rollers 17, a necessary paper feed gap is provided. Further, a larger gap is provided between the base plate 35*a* and the parting roller 17.

With such arrangement, when a set of originals delivered against the original stopper 31 and aligned by the abovementioned preliminary original transfer operation are fed, the front parting plate 35 guides the leading edges of the originals so as to be in alignment with the back surfaces of the base plate 35*a* and the upper plate 35*b* with the lowest originals advancing. Further, the lowest originals are easily pulled to the side of the parting section through the larger gap between the base plate 35*a* and the parting rollers 17. The number of these lowest originals is larger than that of the originals capable of being subjected to a sufficient parting operation at the parting section. However, these lowest originals are parted through the smaller gap between the upper plate 35*b* and the parting rollers 17 into original sets each consisting of an adequate number of originals and they are pulled to the parting section. The parting operation at this time is applied to the small number of originals parted by the base plate 35*a* and therefore it can be easily executed. And if some originals have not sufficiently parted, an adequate number of originals can be easily pulled to the parting section because some originals slip due to flexibility of the upper plate 35*b*.

Accordingly, the front parting plate 35 can part originals into original sets each consisting of a rather small number of originals and easily deliver the same. In this case, the flexibility of the upper plate 35*b* can be optionally determined by selecting the material and the thickness thereof.

The parting pad 18 is formed of rubber having a large friction factor, and is embedded in a part of the lower surface of a pad holder 36. The parting pad 18 and the pad holder 36 are pushed by a spring 37 to be in pressure contact with the parting rollers 17. Thereby, when a small number of originals are fed through the front parting plate 35 to the parting section, the parting pad 18 hinders, from above, the originals from going ahead, so that only the lowest originals which are in contact with the parting rollers having a large transfer power are parted and pulled.

The original pressing members 22, the front parting plates 35 and the parting pads 18 are positioned respectively on the transfer center lines of the pick-up rollers 16 and the parting rollers 17 arranged at both sides of the center line in the direction of the transfer path so that they can surely act on an original subjected to a strong transfer force of the pick-up rollers 16 and the parting rollers 17. Further, with such arrangement, since the points of action of the original pressing members 22, the front parting plates 35 and the parting pads are all symmetrically positioned, an original to be transferred can be prevented from skewing.

The pair of feed rollers 19 are straight rollers and adapted to hold an original delivered from the parting section through the whole width so as to surely feed the same.

At the time when an original reaches the pair of feed rollers 19 and is transferred, the pick-up rollers 16 and the parting rollers 17 are stopped in order to prevent a new original from being delivered from the original tray 11.

Therefore, in this embodiment, the pick-up rollers 16, the parting rollers 17 and the pair of feed rollers 19 are driven by a paper feed motor M1 (FIG. 2), and an electromagnetic clutch CL1 is provided on the drive shaft of the parting rollers 17 (FIG. 3) so that the movements of the parting rollers 17 and the pick-up rollers 16 in interlocked connection therewith can be stopped at a suitable time. Further, a one way clutch 43 is provided between each of the pick-up rollers 16 and the parting rollers 17 and each of their drive shafts 41, 42 respectively. As a result, even if the operation of the pick-up rollers 16 and the parting rollers 17 is stopped, they are driven through idling as long as an original to be transferred by the pair of feed rollers 19 is in contact with them so that the original transfer operation is not hindered.

At a part of the pick-up roller 16, an empty sensor S1 is provided for detecting whether originals are set in the original tray 11, and when the empty sensor S1 detects originals, the original transfer operation can be executed. Directly downstream of the parting section, a paper feed sensor S2 is provided for detecting whether an original is delivered from the parting section. And when the paper feed sensor S2 detects an original, a predetermined time after the original is surely held between the pair of feed rollers 19, the original pressing member 22 is upwardly moved and the electromagnetic clutch CL1 is turned off to stop the drive of the pick-up rollers 16 and the parting rollers 17. Downstream of the pair of feed rollers 19, a U turn path 51 is provided for guiding the original to be transferred from this side of the original scale 3 toward the platen glass 2. At a part of the U turn path 51 near the original scale 3, a pair of timing rollers 52 are provided. And in continuation with the U turn path 51, a transfer belt 53 is provided on the original scale 3 and the platen glass 2.

The pair of timing rollers 52 and the transfer belt 53 are driven by a main motor M2 which is a reversible motor. However, the pair of timing rollers 52 can be stopped at suitable times independently of the transfer belt 53 by turning on and off an electromagnetic clutch CL2 provided in a transmitting system thereof. The pair of timing rollers 52 once first receives the original fed from the pair of feed rollers 19, thereby aligning the leading edge of the original with a nip portion of the timing rollers 52 and correcting the skew of the original. Thereafter, the pair of timing rollers 52 are redriven in timed relation to the copying operation of the copying apparatus A and thereby delivers the position-corrected original to the continuously driven transfer belt 53.

Figure 5:
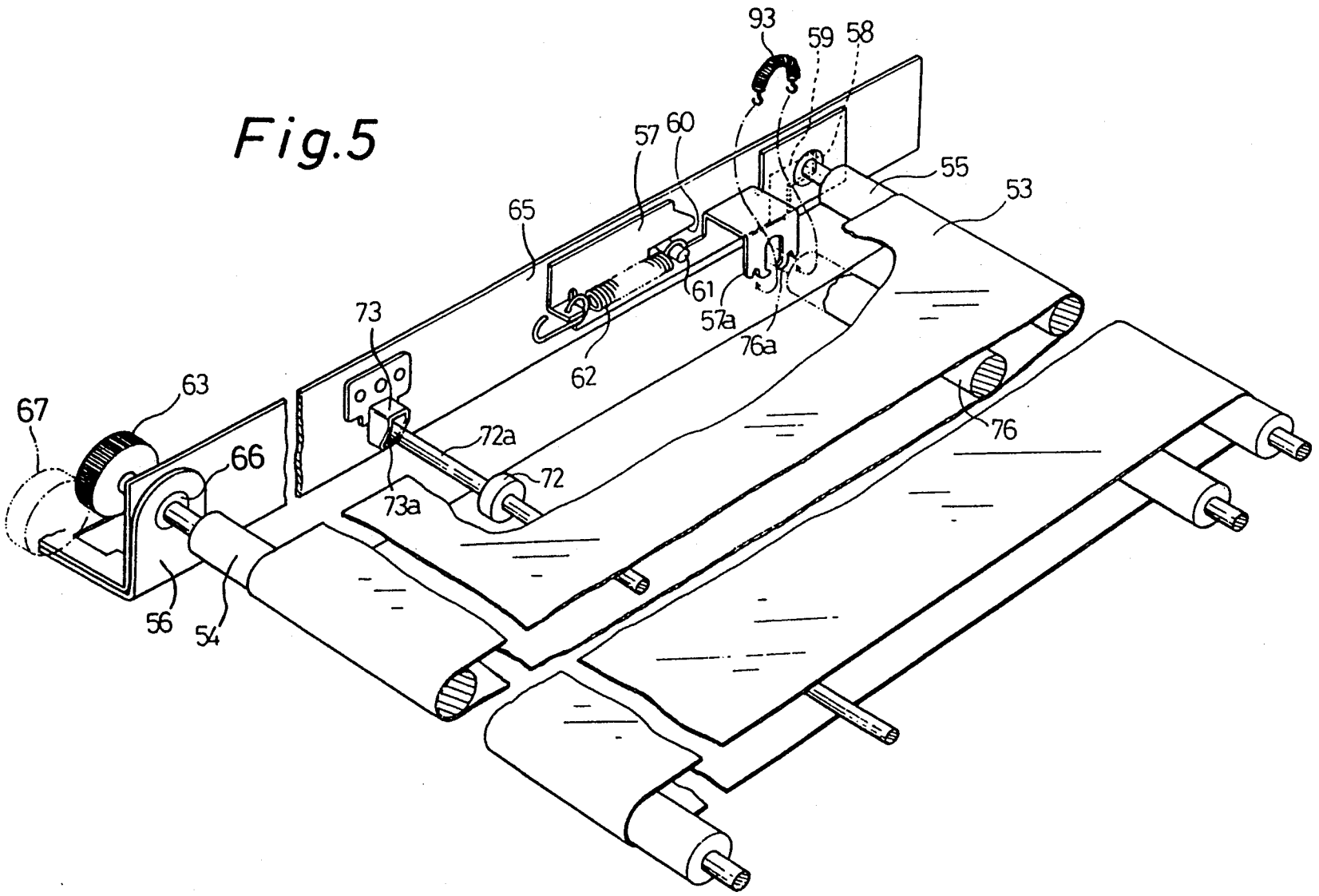
FIG. 5 is a perspective view showing a construction for supporting the transfer belt.
Figure 6:
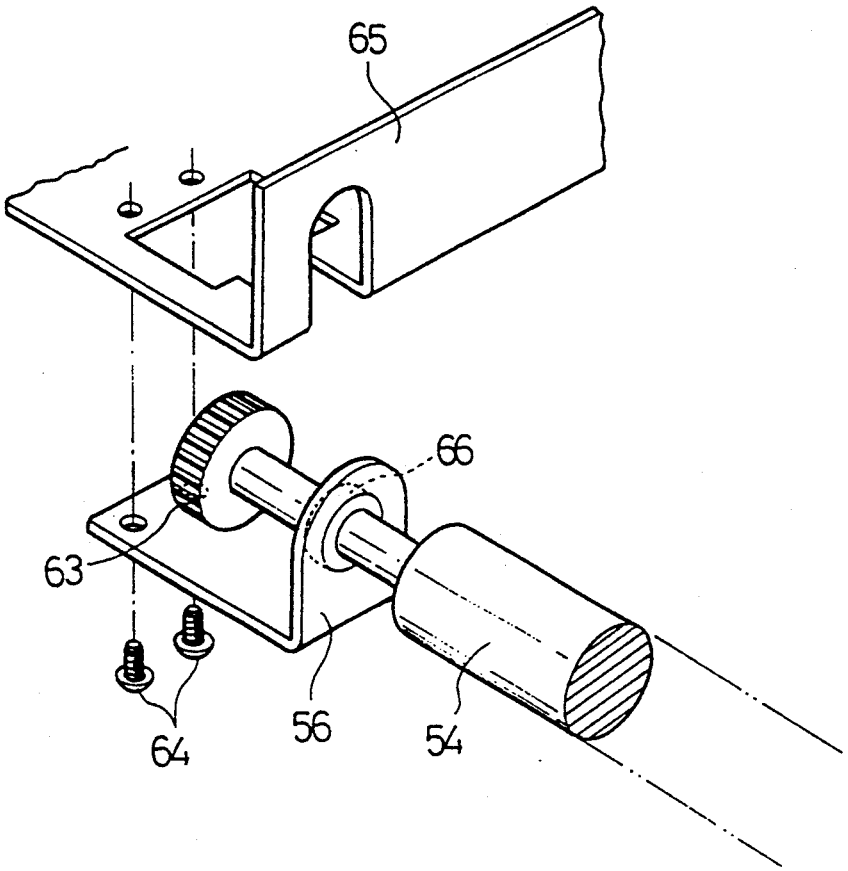
FIG. 6 is a disassembled perspective view showing a construction for supporting a driving roller of the transfer belt.

The transfer belt 53 is stretched by a driving roller 54 and a driven roller 55 both supported by a front and rear frames 65 of the body 13 of the original transfer device so as to be in line with the original scale 3 and the platen glass 2. The front end of the driving roller 54 is detachably carried by a bearing 50 schematically shown in FIG. 5 secured to the front frame 65 of the body 13 of the original transfer device, while the rear end thereof having a passive gear 63 to be connected to the main motor M2 is supported by a holding portion such as 66 fixed to a fitting portion such as fitting plate 56 which is secured to an attaching portion of the rear frame 65 by screwnails 64 so as to be detachable and attachable from below (FIGS. 5 and 6). Thereby, the driving roller 54 is detachable and attachable by detaching and attaching the fitting plate 56 and pulling and inserting the front end thereof out of and into the bearing fixed to the front frames 65, and in accordance therewith, the passive gear 63 comes in and out of engagement with the driving gear 67 connected to the main motor M2. Further, the front end of the driving roller 54 can be detachably and attachably fitted to the front frame 65 in the same manner with that of the rear end thereof.

If necessary, the front end of the driving roller 54 may be mounted on the frame 65 through a member similar to a fitting plate 56. However, with the abovementioned construction, the front end of the driving roller 54 can be detachable from the frame 65 only by pulling the same from the abovementioned bearing and the driving roller 54 can be easily detached.

Figure 3:
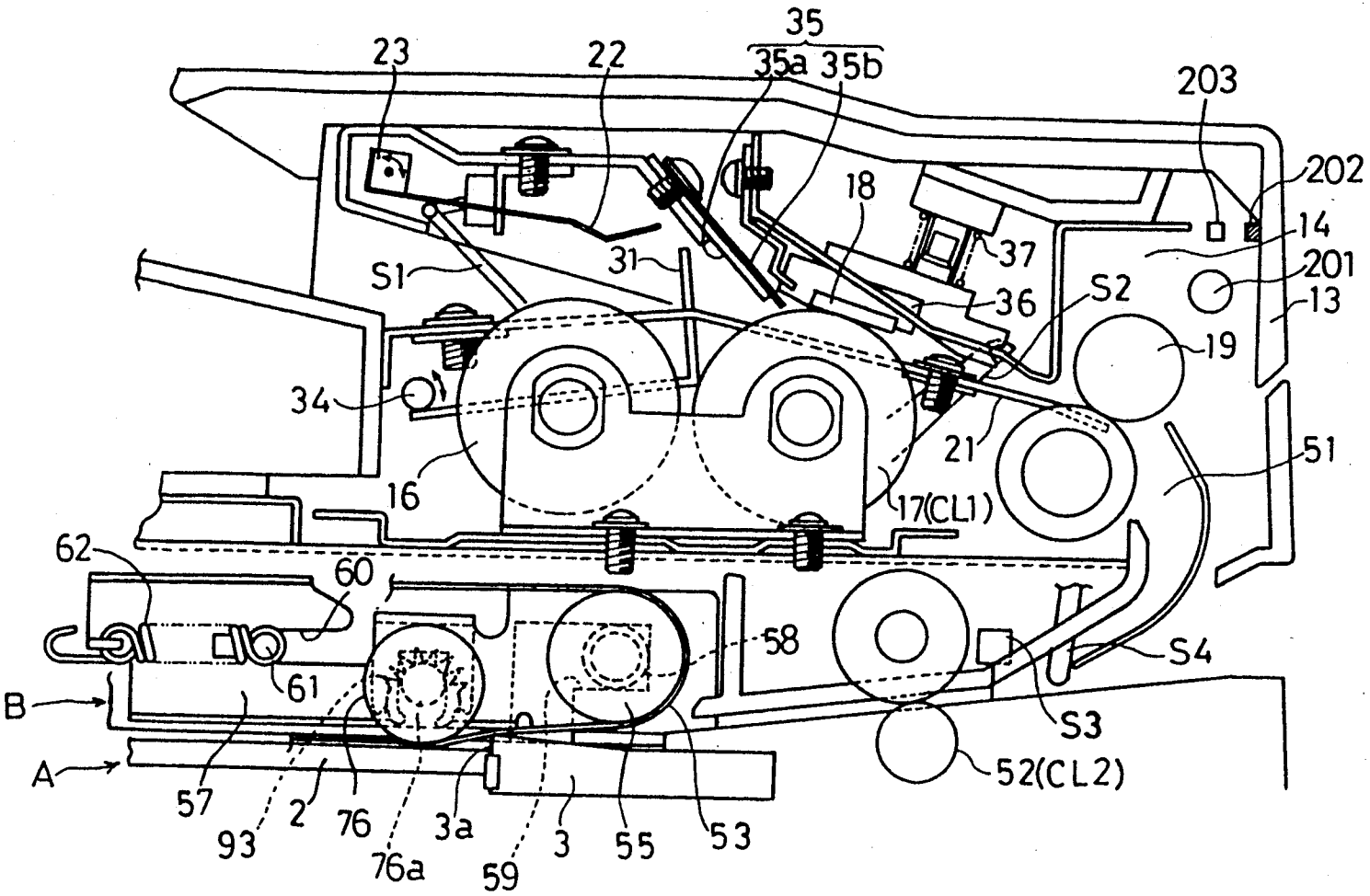
FIG. 3 is an enlarged sectional view of a paper feed section.

As shown in FIGS. 3 and 5, both ends of the driven roller 55 are respectively supported by fitting portions such as slide plates 57 detachably and slidably fitted to the front and rear frames 65 of the body 13 of the original transfer device. Therefore, the driven roller 55 is attached to and detached from the frames 65 by attaching and detaching the slide plates 57 to and from the frames 65. The slide plates 57 are slidably and detachably fitted to the frames 65 by holding portions such as bearings 58 for the driven roller 55 fixed on the slide plates 57 into downwardly opened L-shaped groove attaching portion 59 provided in the front and rear frames 65 respectively and engaging upwardly opened L-shaped groove engagement portions 60 with supporting pins 61 (first supporting portions) provided on the front and rear frames 65. In this fitted state, a force of a spring 62 is acted between each supporting pin 61 and each slide plate 57 so as to pull each slide plate 57 rightwardly in FIG. 2. The slide plates 57, subjected to this pulling force of the springs 62, act to move the driven roller 55 rightwardly in FIG. 2 so that a tension is given to the transfer belt 53 and at the same time the fitted state of the driven roller 55 to the frames 65 is surely maintained.

With the abovementioned construction, the transfer belt 53 can be easily attached and detached by attaching and detaching the driving roller 54 and the driven roller 55 from the body 13 of the original transfer device from below. Therefore, a stay 71 for connecting and strengthening the front and rear frames 65 of the body 13 of the original transfer device is provided above the stretched transfer belt 53.

Further, inside of the transfer belt 53, back-up rollers 72, 76 are provided for urging each part of the transfer belt 53 against the platen glass 2 and thereby securing a transfer force. Rotation shafts **72*a*, 76*a* of the back-up rollers 72, 76 respectively are detachably held by resin holders 73 fixed to the inner surfaces of the front and rear frames 65 and the slide plates 57 so as to prevent the back-up rollers 72, 76 from hindering the attachment and detachment of the transfer belt 53**.

Figure 7:
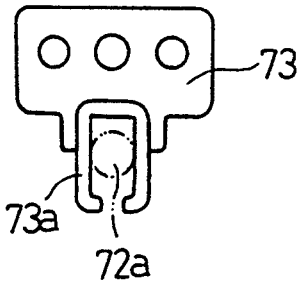
FIG. 7 is a front view of a holder for a back-up roller of the transfer belt.
Figure 9:
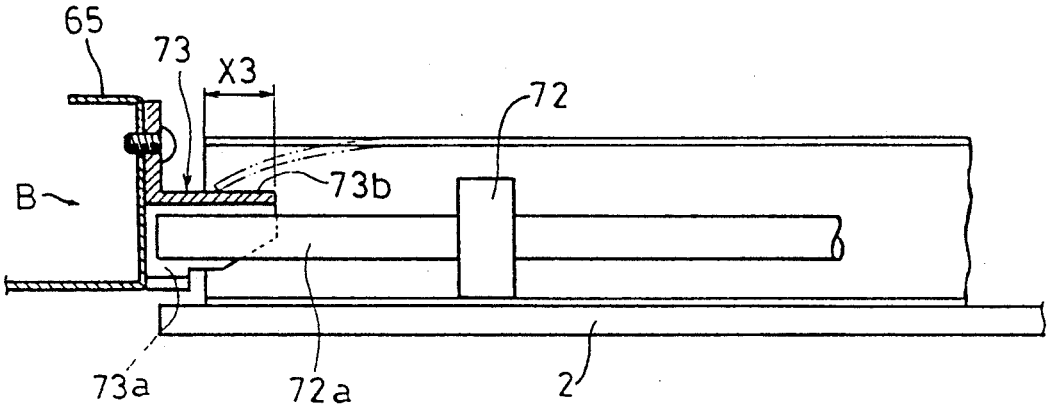
FIG. 9 is a sectional view showing a relation between a construction for supporting the back-up roller and the transfer belt.

As shown in detail in FIGS. 5, 7 and 9, the holder 73 has a pocket portion **73*a* into and from which the rotation shaft 72*a* can be resiliently attached and detached. The pocket portion 73*a* receives the rotation shaft 72*a* and holds the same movably in the vertical direction, so that the back-up roller 72 urges the transfer belt 53 against the platen glass 2** by its own weight.

Especially, an end portion **73*b* of the holder 73 is adapted to be protruded by a suitable amount X3 into the inside of the transfer belt 53. Thereby, if the transfer belt 53 is driven in the positive and negative directions and the ends thereof are caused to shake or the whole of the transfer belt 53 makes a rocking motion, the end parts of the transfer belt 53 are prevented from deviating from the end portion 73*b* of the holder 73 and contacting with the end face of the holder 73. Accordingly it is possible to prevent shortage of life of the transfer belt 53 caused by the friction and damage given to the end parts thereof through such contact between the end parts of the transfer belt 53 and the end face of the holder 73**.

Further, at both end portions of the driving roller 54 and a driven roller 55, flanges **54*a* and 55*a* are provided so as to prevent rocking motion of the transfer belt 53 and thereby further surely prevent the end parts of the transfer belt 53 from contacting with the end face of the holder 73. The abovementioned amount X3 may be suitable determined within a range of that purpose. However, in the pocket portion 73*a* of the holder 73, the rotation shaft 72*a* of the back-up roller 72 is detachably received and held by force of two opposed hooked portions 73*c*. Therefore, if the pocket portion 73*a* is elongated by setting X3 at a large amount, the rigidness of the hooked portions 73*c* becomes high and the back up roller 72 is hard to be attached and detached. Accordingly, the end portion 73*c* is so shaped as to fulfill the amount X3 only at the upper portion thereof, as shown in FIGS. 5 and 9**.

When the transfer belt 53 is positively driven by the operation of the back-up rollers 72, 76, the transfer belt 53 feeds an original delivered from the pair of timing rollers 52 onto the platen glass 2, and discharge an original mounted on the platen glass 2. When the transfer belt 53 is negatively driven, it brings the original fed onto the platen glass 2 into contact with the positioning surface **3*a* of the original scale 3 by switch back, thereby positioning the original on the platen glass 2, or it refeeds the inverted original returning from a paper discharge and returning section 81 disposed at the left side of the original discharge tray 21 in FIG. 2 onto the platen glass 2 and positions the same for the executing a back side copying operation of two side copying. In this case, when a thin paper mode is set in accordance with the controlled amount of returning originals, the originals are brought back just to the position of the original scale 3** and positioned without pressing the same, and in other cases, the originals regarded as front side originals are urged against the original scale and compulsorily positioned.

At a position at this side of the pair of timing rollers 52, a sensor S3 is provided for detecting an original fed from the pair of feed rollers 19. The pair of timing rollers 52 are adapted to be redriven a predetermined time after the sensor S3 detects the original, so that the timing of the abovementioned arrangement of the positions of edges of the originals and the copying operation of the copying apparatus is adjusted. Further, a predetermined time after the sensor S3 detects the original, that is, at the time when the original passes the original scale by a distance X0, the transfer belt 53 is stopped and driven in the negative direction, whereby the positioning of the original is executed by switch-back.

A switch-back amount used for this positioning is so determined as to fulfill the relation $X0<X1$. Accordingly, the original is tried to be switched back by an amount X1 larger than the distance X0 passing the original scale 3, and surely urged against the positioning surface **3*a*, thereby the positioning being executed. And the transfer belt 53 is excessively driven in the negative direction to switch back the original. However, the original urged against the positioning surface 3*a* is not further transferred in the negative direction but stretches itself owing to its own firmness and slips on the transfer belt 53**, whereby no problem is caused.

On the other hand, if the original is thin and feeble, it cannot stretch itself after it is urged against the positioning surface 3a, and is folded or finely wrinkled in a triangle space defined by the platen glass 2, the original scale 3 and the transfer belt 53. In order to prevent this, the abovementioned usual original positioning mode using switch-back is changed over to a thin original mode only when a thin original mode setting key (not shown) is set, and the original transfer amount required for the rear edge of the original reaching the position of the positioning surface 3a is found by setting the time after the sensor S3 detects the rear edge of the original and the transfer belt 53 is stopped at that time, whereby the positioning of the original is executed without switch-back.

The size of each path between the two back-up rollers 72, 76, or between each back-up roller and any transfer means disposed in front of or behind the back-up roller is so determined as to be smaller than the smallest size of an original measured in the transfer direction. Thereby, a small sized original can be also surely transferred. However, the back-up roller 76 at the side of the driven roller 55 has to be at a position close to the driven roller 55. Therefore, the back-up roller 76 is adapted to be supported by the abovementioned slide plate 57 together with the driven roller 55 and is attached and detached also together with the driven roller 55. For this purpose, a back-up roller holding portion 57a is integrated with the slide plate 57, so that the back-up roller 76 is supported by the holding portion 57a so as to be movable in the vertical direction. The back-up roller 76 is pushed downwardly by a spring 93 (FIGS. 3 and 5) acting between the back-up roller 76 and the holding portion 57a, whereby the transfer belt 53 is urged against an edge of the original scale 3 at the side of the positioning surface 3a. Therefore, such a trouble can be prevented that an original switched back or positioning goes back beyond the positioning surface 3a.

In the transfer operation, the length of an original in the transfer direction can be determined based on the relation between the time from the time of detecting the leading end of the original to the time of detecting the rear end thereof and the original transfer speed. By combining thus obtained length of the original with original width data from a width sensor S4 provided in the way of the U turn path 51, the size of the original including whether the original is transferred in lengthways or sideways can be judged. This judgement is used in selecting a paper cassette and a copying magnification in the copying apparatus.

In a paper discharge and return section 81, there is provided a U turn path 82 in continuation with the platen glass 2 and reaching an original discharge tray 12. In the way of the U turn path 82. A contrarotating roller 83 is provided in the way of the U turn path 82. Further, a paper discharge roller 85 is provided at a paper discharge opening section 84 opened to the original discharge tray 12. Further, a return path 86 is provided for returning an original from the middle of the U turn path 82 along the contrarotating roller 83 onto the platen glass 2.

The contrarotating roller 83 and the paper discharge roller 85 are driven simultaneously with the transfer belt 53 by the main motor M2. However, the driving system of the main motor M2 consists of a first driving system in which only rotations of the main motor M2 are transmitted as right rotations through a one way clutch, and a second driving system in which only contrarotations of the main motor M2 are transmitted and oil changed over through a one way clutch to right rotations, so that the contrarotating roller 83 and the paper discharge roller 85 are always rotated only in the right direction whether the main motor is rightly rotated or contratotated, that is, whether the transfer belt 53 is driven in the positive or negative direction. Two small contrarotating rollers 87, 88 provided in pressure contact with the contrarotating roller 83 so that they are driven for urging an original along the contrarotating roller 83.

At an entrance of the U turn path 82, a lower contrarotating guide 89 is provided for guiding an original transfer by the transfer belt 53 from the platen glass 2 onto the U turn path 82 and then between the contrarotating roller 83 and the small contrarotating roller 87.

Figure 1:
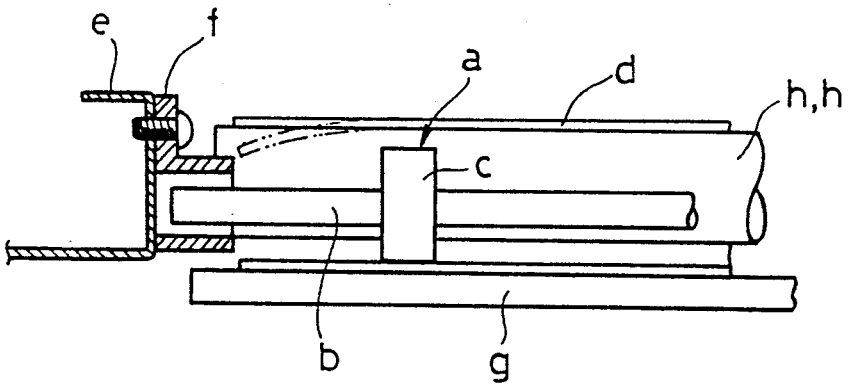
Fig.1 PRIOR ART
FIG. 1 is a sectional view showing a relation between a transfer belt and a bearing for a shaft of a back-up roller of a conventional original transfer apparatus.

The original guided into the U turn path 82 is transferred by the contrarotating roller 83 and the small contrarotating rollers 87, 88. A changeover claw 91 is provided at the position where the return path 86 of the U turn path 82 branches. When the changeover claw 91 is at the position shown in solid line in FIG. 1, it guides the transferred original to the side of paper discharge opening 84 so that the original is discharged by the paper discharge roller 85 onto the original discharge tray 12. On the other hand, when the changeover claw 91 is at the position shown in an imaginary line in FIG. 1, it guides the transferred original to the side of the return path 86.

Directly at this side of the small contrarotating roller 87, a paper discharge sensor S5 is provided. When the sensor S5 detects an original, a predetermined time after the detection, that is, before the original has passed the paper discharge roller 85, the rotation speed of the main motor M2 is lowered, whereby the original is prevented from flying onto the original discharge tray 12. And at the same time, through the detection of the original by the sensor S5, timings for driving the transfer belt 53 in the reverse direction and the like can be obtained.

As shown in FIGS. 2 and 8, in the original discharge tray 12, wave-shaped original receiving ribs 12b, 12c, 12d are provided successively in the original discharging direction on a horizontal bottom surface 12a. These original receiving ribs are respectively disposed in correspondence with the sizes of originals in the transfer direction in such a manner that the peak of each rib is a little behind the position of the center of gravity of an original received by the rib. With such arrangement, a discharged original is transferred successively beyond the ribs by transfer power of the paper discharge roller 85 till it reaches a rib corresponding to the size of the original in the transfer direction. And when the discharged original reaches the rib corresponding to its size, it goes beyond the peaks of the ribs. However, since the discharged original is off from the paper discharge roller 85 and is no longer transferred before the position of the center of gravity of the discharged original goes beyond the peaks of the ribs, resisting force against the original transfer at the peaks overcomes the force of forward movement of the discharged original. Consequently, the original is settled with its rear end being a little apart from the rear wall of the original discharge tray 12 having the paper discharge opening 84, and any size of original is settled in this position.

The rear original receiving rib 12d is formed to be low in consideration with the relation of position between the same and the original tray 11. Therefore, a resin film 92 is provided on the original tray 11 and a long original is lightly pushed on the original receiving rib 12*d* so that the rib 12*d* can serve similarly as the other original receiving ribs 12*b*, 12*c* do.

As abovementioned according to this embodiment, the operation of exchanging the transfer belt 53 is carried out in the following steps: the automatic original transfer device B is opened upwardly; then the back-up roller 72 supported by the holder 73 is taken out from the side of the lower surface of the original transfer device B, then the spring 62 giving a tension on the transfer belt 53 is detached from the slide plate 57, then by loosening the screw nails 64, the fitting plate 56 supporting the rear end of the driving roller 54 is detached from the frame 65 and pulled downwardly and at the same time the front end of the driving roller 54 is pulled out from the bearing thereof whereby the driving roller 54 is taken out; then, after the slide plates 57 supporting two ends of the driven roller 55 are displaced leftwardly in FIG. 2, the supporting pins 61 for the frame 65 are pulled out from the L shaped grooves 60 and the bearings 58 are pulled out from the L shaped grooves 59; thereby the driven roller 55 and the slide plate 57 are taken out from the body 13 of the original transfer device B, and at the same time the transfer belt 53 is also taken out therefrom and exchanged with a new transfer belt 53.

The new transfer belt 53 can be fitted to the body 13 of the original transfer apparatus B by carrying out the abovementioned steps in the reverse order.

In this embodiment, a tension is given to the transfer belt 53 by pushing the driven roller 55 through the spring 62. However, if the transfer belt 53 formed of a resilient material is used and the driven roller 55 is fitted to the frame 65 in the same manner as the driving roller 54 is fitted, the driven roller 55 can be more easily detached from the original transfer apparatus B.

Figure 10:
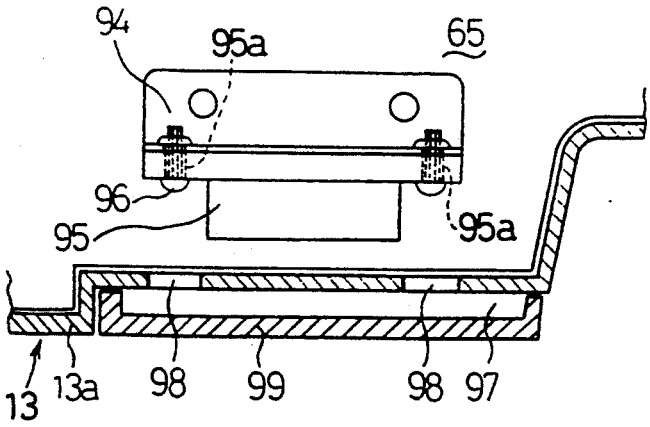
FIG. 10 is a sectional view showing a fitting of a magnet unit for attaching the original transfer apparatus to a copying apparatus.
Figure 11:
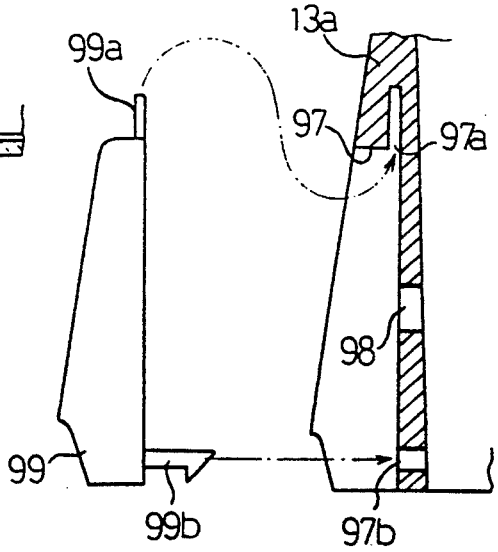
FIGS. 11 and 12 are sectional and perspective views, respectively, showing an auxiliary cover of a magnet unit fitting portion in an unifitted state.

Further, in this embodiment, as shown in FIG. 10, a magnet unit 95 is fitted adjustably in the vertical direction to a fitting bracket 94 fixed on the front frame 65 of the body 13 of the original transfer apparatus B. This fitting of the magnet unit is executed by penetrating fitting screw nails through long holes 95*a* provided in the magnetic unit 95 and securing the same. With such arrangement, by loosening the fitting screw nails 96 and thereby making the magnet unit 95 to be attracted by a magnetic member fixed on the upper surface of the copying apparatus with the automatic original transfer apparatus B being mounted on the upper surface of the copying apparatus A, and then by tightening the fitting screw nails 96 and thereby positioning the magnet unit 96, the whole surfaces of the platen glass 2 and the transfer belt 53 are without fail in uniform close contact with each other when the automatic original transfer device is closed. On the contrary, the magnet unit 95 may be provided on the upper surface of the copying machine A with the magnetic member fixed on the automatic original transfer apparatus B.

Figure 12:
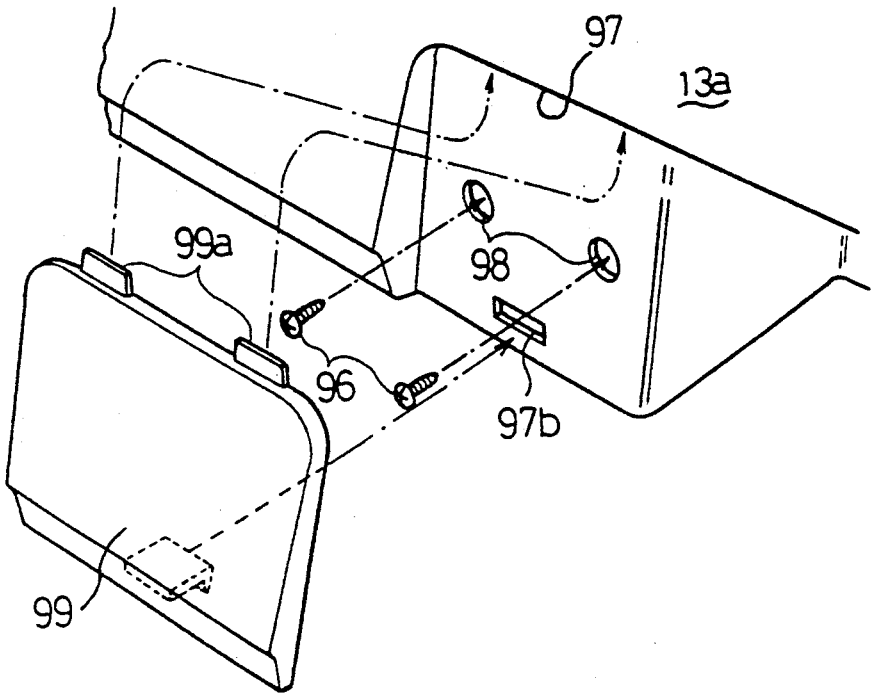

Further, as shown in FIGS. 10 and 12, in order to easily execute the adjustment of the position of the magnet unit 95 by means of the fitting screw nails 96 from outside of a cover 13*a* of the body 13 of the automatic original transfer apparatus B, magnet unit disposing portions provided on both sides of a hold portion 13*b* of the cover 13*a* are recessed below the outer surface to form recessed portions 97 and a hole for operating the fitting screw nails 96 is provided in the inner side wall of each recessed portion 97. Further, an auxiliary cover 99 for covering the recessed portion 97 is adapted to be attached or detached by engaging an engagement piece 99*a* upwardly protruding from the upper end of the auxiliary cover 99 and an engagement piece 99*b* horizontally protruding from the lower end thereof with corresponding engagement holes 97*a*, 97*b* respectively provided in the recessed portion 97.

Figure 13:
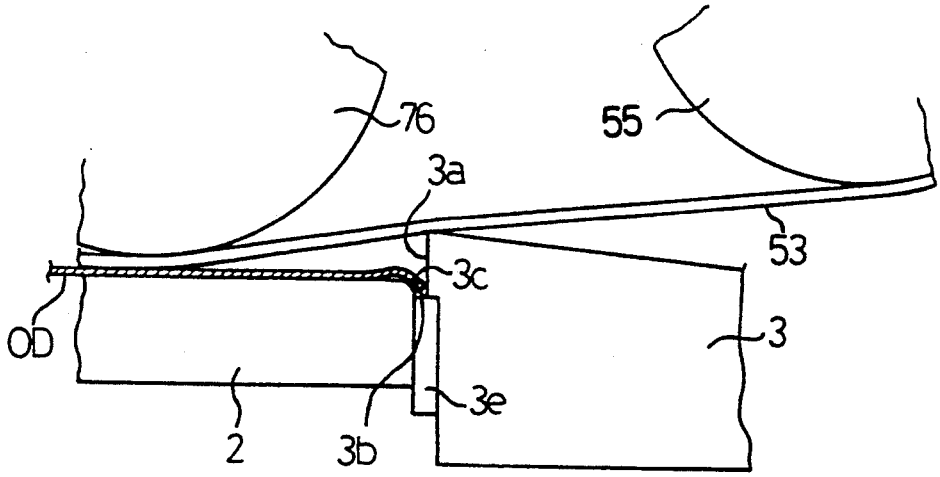
FIG. 13 is an enlarged sectional view showing a platen glass and an original scale in contact with each other.
Figure 14:
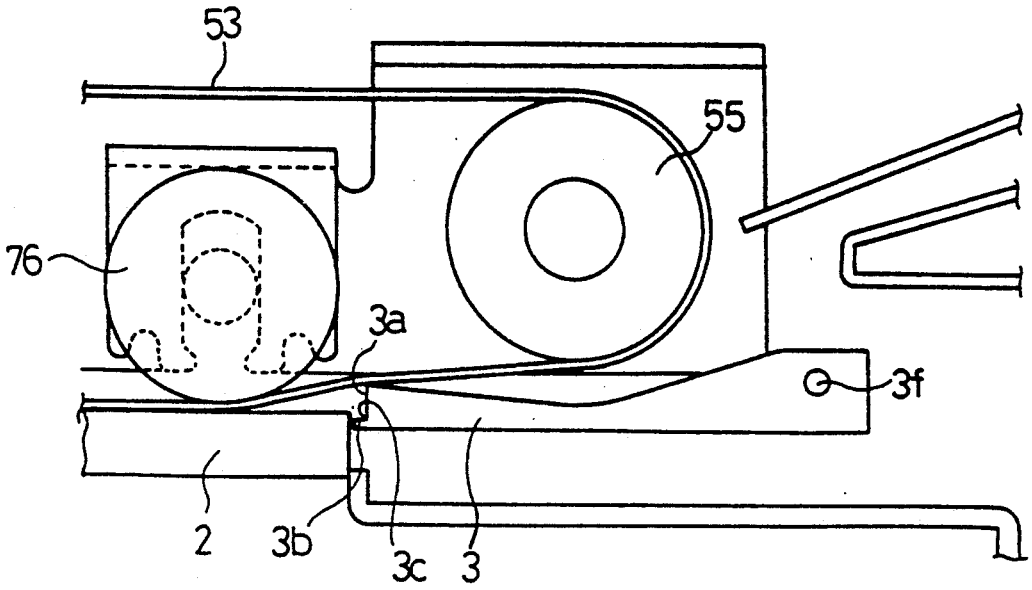
FIGS. 14 and 15 are sectional views showing second and third embodiments of the present invention.
Figure 15:
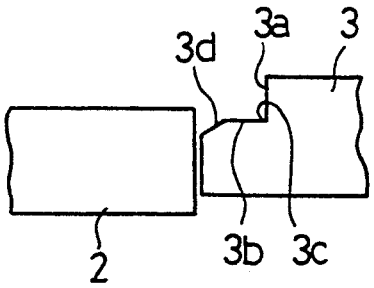

Further, as shown in FIG. 13, in the lower portion of the positioning surface 3*a* of the original scale 3, a hooked surface having a horizontal surface a little lower than the upper surface of the platen glass 2 is provided. With this arrangement, when the original OD is transferred in the negative direction to be urged against the positioning surface 3*a* and positioned, the rear end of the original OD is received by a corner portion 3*c* of the hooked surface 3*b* and can be prevented from being inserted into a space if any, between the original scale 3 and the platen glass 2. Furthermore, since the horizontal surface of the hooked surface 3*b* is formed of an elastic member 3*c* such as a rubber member adhered and secured to the leading end of the original scale 3, it also functions as a pad for eliminating a space between the original scale 3 and the platen glass 2, so that the original OD can be more surely prevented from being inserted into a space therebetween. However, if the horizontal surface of the hooked surface 3*b* can surely receive an original, there may be a little space between the original scale 3 and the platen glass 2. For ensuring such receipt of an original by the hooked surface 3*a*, it is only necessary that the horizontal surface of the hooked surface 3*b* is below the upper surface of the platen glass 2 as shown in the second embodiment of FIG. 14, or, if not below the same, an upward slope 3*d* extending from a position below the upper surface of the platen glass 2 to the horizontal surface is provided for guiding an original OD to the horizontal surface as shown in the third embodiment of FIG. 15. In FIG. 14, the leading end of the original scale 3 is vertically moved through the pivotal movement thereof about a shaft 3*f*. However, each of the abovementioned two cases of the horizontal surface of the hooked surface 3*b* can be applied to an original scale 3 either of movable type or of fixed type.

What is claimed is:

1. An original transfer apparatus for transferring an original to a platen, comprising:
   - a frame of a body;
   - a pair of rotatable rollers opposed to each other, each of said pair of rotatable rollers having a shaft;
   - a transfer belt stretched between the pair of rotatable rollers; and
   - roller holding members for releasably attaching the shaft of each of the pair of rotatable rollers to the frame in such a manner that each end of each shaft of each of the pair of rollers is individually attachable to and detachable from the frame in the same direction.

2. An original transfer apparatus as claimed in claim 1, wherein the frame of the body has attaching portions opposed to the platen, and each of the roller holding members has a holding portion for rotatably holding the shaft of the rollers and a fitting portion for detachably fitting the holding portion to the attaching portion from the side of the frame opposed to the platen.

3. An original transfer apparatus as claimed in claim 1, wherein the frame of the body is provided with a first supporting portion for supporting one of the roller holding members slidably in an original transfer direction and a second supporting portion for detachably supporting the one of the roller holding members, and the one of the roller holding members has an engagement portion to be engaged with the first supporting portion and a roller holding portion for rotatably holding the shaft of one of the rollers and being engaged with the second supporting portion.

4. An original transfer apparatus as claimed in claim 3, wherein the first supporting portion is a pin and the second supporting portion is a guide groove having a downwardly opened vertical groove and a lateral groove connected to the vertical groove, and the engagement portion is an upwardly opened lateral groove.

5. An original transfer apparatus as claimed in claim 4, wherein the one of the roller holding members holds the one of said pair of rotatable rollers, and the apparatus further comprises a second roller holding member unmovably fixed to the frame of the body and supporting another one of said pair of rotatable rollers.

6. An original transfer apparatus as claimed in claim 5, further comprising:

a spring member detachably mounted between the one roller holding member and the frame of the body, and urging the one roller holding member in the direction for giving a tension to the transfer belt; and a transmitting means including a driving gear provided on a side of the frame of the body and connected to a driving source of the transfer belt, and a driven gear fitted to the another roller to be held by the second roller holding member and adapted to be engaged with and disengaged from the driving gear when the said another roller to be held by said second roller holding member is attached to and detached from the frame of the body.

7. An original transfer apparatus for transferring an original to a platen, comprising:

a frame of a body;

a pair of rollers opposed to each other;

a transfer belt stretched between the pair of rollers;

a first roller holding member detachably fitted to the frame of the body from the side opposed to the platen and slidably held with respect to the frame for rotatably holding an end of the shaft of a first one of the pair of rollers, a second roller holding member detachably fitted to the frame of the body from the side opposed to the platen and unmovably held with respect to the frame for rotatably holding an end of the shaft of a second one of said pair of rollers; and a spring member detachably provided to act between the frame of the body and the first roller holding member and adapted to urge the first one of said pair of rollers in the direction for giving a tension to the transfer belt.

8. An original transfer apparatus as claimed in claim 7, wherein the device further comprises a third roller holding member fixed to the frame of the body and adapted to hold the other end of the shaft of the second roller of said pair of rollers rotatably and detachably in the direction of the axis of the shaft.

9. An original transfer apparatus for transferring an original to a platen, comprising:

a frame of a body;

a pair of rollers opposed to each other, each of the pair of rollers having a shaft;

a transfer belt stretched between the pair of rollers;

roller holding members for releasably attaching the shaft of each of the pair of rollers to the frame in such a manner that ends of each shaft of each of the pair of rollers is attachable to and detachable from the frame in the same direction;

a pressing roller provided between the pair of rollers and adapted to press the transfer belt against the platen; and a pressing roller holding member for rotatably holding a shaft of the pressing roller to the frame and attachable and detachable in the same direction as the pair of rollers are attached and detached.

10. An original transfer apparatus as claimed in claim 9, wherein the pressing roller holding member is formed of a resilient member and has a pocket portion for holding the pressing roller movably in the vertical direction, the pocket portion being provided with a downwardly opened opening and a pair of hooked portions opposed to each other at this opening.

11. An original transfer apparatus as claimed in claim 10, wherein the frame of the body is provided with a first supporting portion for supporting one of the roller holding members slidably in an original transfer direction, and a second supporting portion for detachably supporting the one of the roller holding members, and the one of the roller holding members is provided with an engagement portion to be engaged with the first supporting portion, a roller holding portion for rotatably holding the shaft of the one of the rollers and being engaged with the second supporting portion and a holding portion for movably holding the shaft of the pressing roller in the vertical direction.

12. An original transfer apparatus for transferring an original to a platen, comprising:

a frame of a body;

a pair of rollers opposed to each other;

a transfer belt stretched between the pair of rollers;

first roller holding members detachably fitted to the frame from a side opposed to the platen and adapted to rotatably hold two ends of a shaft of one roller of said of rollers and one end of a shaft of another roller of said pair of rollers detachable in a direction of the platen;

a second roller holding member fixed to the frame of the body and adapted to rotatably hold another end of the shaft of said another roller of said pair of rollers detachable in an axial direction of the shaft thereof;

a pressing roller provided between the pair of rollers and adapted to press the transfer belt against the platen; and a pressing roller holding member for rotatably holding a shaft of the pressing roller and attachable and detachable in the same direction as the first roller holding members are attached and detached.

13. An original transfer apparatus for transferring an original to a platen, comprising:

a frame of a body;

a pair of rollers opposed to each other with a space therebetween;

roller holding members for holding ends of shafts of the pair of rollers to the frame;

a transfer belt stretched around the pair of the rollers;

a pressing roller provided between the pair of rollers and adapted to press the transfer belt against the platen; and a pressing roller holding member having a portion for rotatably holding a shaft of the pressing roller to the frame and a portion for limiting deflection of the transfer belt.

14. An original transfer apparatus as claimed in claim 13, wherein the roller holding members hold the ends of the shafts of the pair of rollers to the frame so as to be attachable and detachable in the same direction, and the pressing roller holding member is detachably fitted to the frame.

15. An original transfer apparatus as claimed in claim 14, wherein the roller holding members hold the ends of the shafts of the pair of rollers to the frame so as to be attachable and detachable in the same direction, and the pressing roller holding member is fixed to the frame of the body and has a pocket portion adapted to hold the shaft of the pressing roller movably in the vertical direction, the pocket portion having an upwardly faced guide surface elongated in the direction of an axis of the pressing roller and a downwardly opened opening the width of which is smaller than a diameter of the pressing roller.

16. An original transfer apparatus as claimed in claim 14, wherein the pair of rollers has flanges for regulating ends of the transfer belt.

* * * * *

UNITED STATES PATENT AND TRADEMARK OFFICE

CERTIFICATE OF CORRECTION

PATENT NO. : 5,213,322

DATED : May 25, 1993

INVENTOR(S) : Hirokazu Matsuo, et al.

It is certified that error appears in the above-identified patent and that said Letters Patent is hereby corrected as shown below:

In col. 10, line 1, change "oil" to --are--.

In col. 10, line 7, before "provided" insert --are--.

In col. 14, line 38 (Claim 12, line 9) after "said" insert --pair--.

Signed and Sealed this

Fifth Day of April, 1994

Bruce Lehman

*Attest:*

BRUCE LEHMAN

*Attesting Officer*

*Commissioner of Patents and Trademarks*